US011472609B2

(12) United States Patent
Wong

(10) Patent No.: US 11,472,609 B2
(45) Date of Patent: Oct. 18, 2022

(54) SPOUT UNIT, LID ASSEMBLY COMPRISING THE SPOUT UNIT, BEVERAGE CONTAINER AND METHOD FOR MANUFACTURING THE SPOUT UNIT

(71) Applicant: AEGIS GLOBAL RESOURCES (HK) LIMITED, Hong Kong (HK)

(72) Inventor: Siu Wah Wong, Hong Kong (HK)

(73) Assignee: AEGIS GLOBAL RESOURCES (HK) LIMITED, Hong Kong (HK)

( * ) Notice: Subject to any disclaimer, the term of this patent is extended or adjusted under 35 U.S.C. 154(b) by 0 days.

(21) Appl. No.: 17/142,434

(22) Filed: Jan. 6, 2021

(65) Prior Publication Data

US 2021/0206541 A1 Jul. 8, 2021

Related U.S. Application Data

(60) Provisional application No. 62/957,538, filed on Jan. 6, 2020.

(51) Int. Cl.

| | |
|---|---|
| ***B65D 47/06*** | (2006.01) |
| ***B65D 47/08*** | (2006.01) |
| ***B65D 25/42*** | (2006.01) |
| ***B65D 85/72*** | (2006.01) |
| ***B65D 25/52*** | (2006.01) |
| ***B65D 47/12*** | (2006.01) |
| ***B65D 51/18*** | (2006.01) |
| ***B65D 83/00*** | (2006.01) |
| ***B65D 41/04*** | (2006.01) |

(52) U.S. Cl.

CPC ..... *B65D 47/0833* (2013.01); *B65D 25/42* (2013.01); *B65D 25/52* (2013.01); *B65D 41/04* (2013.01); *B65D 47/066* (2013.01); *B65D 47/122* (2013.01); *B65D 51/18* (2013.01); *B65D 83/00* (2013.01); *B65D 85/72* (2013.01); *B65D 2251/1066* (2013.01); *B65D 2547/063* (2013.01)

(58) Field of Classification Search

CPC .. B65D 47/0833; B65D 25/42; B65D 47/066; B65D 2251/1066; B65D 2547/063; B65D 85/72; B65D 25/52; B65D 41/04; B65D 47/122; B65D 51/18; B65D 83/00

See application file for complete search history.

(56) References Cited

U.S. PATENT DOCUMENTS

| | | | | |
|---|---|---|---|---|
| 4,560,081 | A * | 12/1985 | Adams | B65D 47/063 222/530 |
| 5,332,131 | A * | 7/1994 | Pehr | B65D 47/2006 222/536 |
| 9,380,898 | B2 * | 7/2016 | Mason | A47G 19/2272 |
| 10,059,491 | B2 * | 8/2018 | Wong | B65D 43/0225 |

(Continued)

*Primary Examiner* — Frederick C Nicolas
(74) *Attorney, Agent, or Firm* — WPAT, PC

(57) ABSTRACT

The present invention provides a spout unit for dispensing beverage in a beverage container, including a spout and a reinforcement unit overmolded with the spout. The reinforcement unit includes a device for reinforcing interlocking of the reinforcement unit with the spout, for example shut off holes and/or depressions, at least a pair of tabs, and one or more outwardly facing longitudinal grooves. This invention also relates to a lid assembly including the spout unit, and a beverage container assembly including such a lid assembly. Furthermore, this invention provides a method for manufacturing the spout unit.

20 Claims, 17 Drawing Sheets

(56) References Cited

U.S. PATENT DOCUMENTS

| | | | | |
|---|---|---|---|---|
| 2010/0170902 | A1* | 7/2010 | Britto | A47G 19/2266<br>220/709 |
| 2011/0031277 | A1* | 2/2011 | Maas | B05B 1/30<br>264/572 |
| 2012/0043295 | A1* | 2/2012 | Webster | B65D 47/06<br>215/44 |
| 2016/0176589 | A1* | 6/2016 | Averill | B01F 25/43161<br>222/190 |
| 2016/0207672 | A1* | 7/2016 | Wong | B65D 47/0857 |
| 2021/0002041 | A1* | 1/2021 | Starner | B65D 47/066 |

* cited by examiner

A-A

C-C

SPOUT UNIT, LID ASSEMBLY COMPRISING THE SPOUT UNIT, BEVERAGE CONTAINER AND METHOD FOR MANUFACTURING THE SPOUT UNIT

FIELD OF THE INVENTION

This invention relates generally to a spout unit for dispensing beverage in a beverage container, and in particular a spout unit comprising a mouthpiece that is prevented from releasing from the spout unit. This invention also relates to a lid assembly comprising the spout unit, and a beverage container assembly comprising such a lid assembly. Furthermore, this invention provides a method for manufacturing the spout unit.

BACKGROUND OF THE INVENTION

Beverage containers with a spout unit facilitate a user to drink any time beverages held in the container. Given a variety of beverages, such as water, soup, milk, juice, soft drinks, coffee, tea or shakes, are commonly consumed, a high tolerance of the spout unit under various temperature, pH value is required. While repeated washing is required for beverage containers, in particular sterilization with hot water, steam or microwave, durability is an important aspect for consumers of such products. For beverage container designated for infants or kids, abused use of the spout unit of the beverage container shall be considered.

Presently, the spout unit comprises a soft spout having a mouthpiece and a base coupled with the spout. The soft spout protrudes beyond a body of the lid for dispensing of the contents inside the beverage container and for better comfort. Generally, a bonder is applied to bond the base and the spout in surface contact manner. There is no interlocking structure or feature to permanently adhere the base and the spout together. Therefore, the spout can be easily released from the base subject to the repeated and/or abused use of the beverage container assembly.

Accordingly, there is a need for designing a spout unit with higher strength and increased twisting torque to prevent releasing or separation of the spout from the base.

SUMMARY OF THE INVENTION

The present invention has a principle object of providing a spout unit use in conjunction with a lid for a beverage container, comprising a device for reinforcing to achieve higher strength and resistance to twisting and tearing.

This and other objects are satisfied by a first aspect of the present invention, which provides a spout unit for dispensing beverage in a beverage container, comprising:

a spout comprising a mouthpiece having a dispensing orifice, and a neck extending downwardly from the mouthpiece, a reinforcement unit overmolded with the spout, wherein the reinforcement unit comprises:

a main body having a top wall and a receiving chamber, a linking portion extending from the main body to protrude beyond the top wall of the main body for engaging the spout, the linking portion having a bore which extends through the linking portion and is in fluid communication with the dispensing orifice of the spout, and a device for reinforcing structurally interlocking of the reinforcement unit with the spout.

The essence of the invention is to reinforce the interlocking of the reinforcement unit with the spout in the structural sense. In one embodiment, the device for reinforcing may include one or more shut off holes and/or depressions adapted to receive flow of material from the spout in the overmolding process, and the flow of material forms one or more ridges on an outer side surface of the neck of the spout, thereby generating interlocking of the spout and the reinforcement unit. Preferably, the shut off holes and/or depressions are distributed circumferentially on the top wall. In order to improve the interlocking of the spout and the reinforcement unit, the device for reinforcing may include at least a pair of tabs extending transversely from opposite outer side wall surfaces of the linking portion, the pair of tabs being positioned to engage a pair of inwardly facing grooves opposite to and facing each other on the two opposite inner side walls of the spout. In one preferred embodiment of the invention, two pairs of tabs extend transversely from opposite outer side wall surfaces of the linking portion, respectively, each of the pairs of tabs being positioned to engage a pair of inwardly facing grooves opposite to and facing each other on the two opposite inner side walls of the spout.

In some cases, one or more outwardly facing longitudinal grooves may be formed axially in each of the tabs, the one or more longitudinal grooves adapted to receive flow of material from the spout in the overmolding process, and the flow of material forms one or more ribs on an inner side wall of the mouthpiece of the spout. Such features can provide additional structure for interlocking of the spout and the reinforcement unit.

In one embodiment of the invention, the reinforcement unit may comprise a first bulge and a second bulge provided on opposite side walls of the main body thereof, the first and second bulges configured as a first pivot and a second pivot for pivotably mounting the spout unit on the lid body.

In one embodiment of the invention, the receiving chamber may comprise a pair of lateral slots opposite to and facing each other on two opposite inner sides of the receiving chamber.

Preferably, the spout and the reinforcement unit are overmolded as a unitary structure. The spout may be made of a flexible material, and the reinforcement unit may be made of a rigid material. In one embodiment of the invention, the spout comprises silicon material, and the reinforcement unit comprises nylon material.

A second aspect of this invention provides a lid assembly coupled to a beverage container for covering an opening of the beverage container, comprising a lid comprising a lid body adapted to be placed over and coupled to the opening of the container, and a spout unit according to this invention.

In one particular embodiment of the invention, the lid assembly may further comprise a drinking straw having one end portion received in the receiving chamber of the main body of the reinforcement unit and in fluid communication with the mouthpiece of the spout. The receiving chamber comprises a pair of lateral slots opposite to and facing each other on two opposite inner sides of the receiving chamber, and the pair of slots are adapted to engage the end portion of the drinking straw.

In one preferred embodiment of the invention, the lid assembly may further comprise a cover member pivotably mounted on the lid body and pivotal between a locked position where the spout unit is allowed to fold into a stowed configuration, and an unlocked position where the cover member pivots upwardly, thereby allowing the spout unit to unfold into a dispensing configuration for dispensing the beverage. A locking unit may be pivotally mounted on the lid body for locking the cover member in the locked position when the locking unit is engaged with the cover member and unlocking the cover member when the locking unit is disengaged from the cover member.

A third aspect of the present invention provides a beverage container assembly comprising a beverage container having an opening, and a lid assembly according to this invention for coupling to the opening of the container.

A fourth aspect of the present invention relates to a method for manufacturing a spout unit according to this invention, comprising the steps of:

(a) injection-molding the reinforcement unit, (b) heating the injection-molded reinforcement unit at a predetermined temperature for a period of time, (c) placing the heated reinforcement unit in an overmolding mold, (d) applying a material of the spout into the overmolding mold for overmolding the spout around the linking portion of the reinforcement unit, and (e) demolding the overmolded spout unit.

In one embodiment, the method further comprises a step of applying a primer onto at least a part of the reinforcement unit intended to come into contact with the spout prior to the step (b) of heating. The part of the reinforcement unit to be in contact with the spout may be selected from the group consisting of the top wall, the tabs, the shut off holes or depressions, the grooves and any combination thereof.

Step (b) of heating may be conducted at a temperature between 120° and 200°, preferably between 130° and 180° for 10 to 30 minutes, preferably for 20 minutes.

The method may further comprises a step of trimming and inspecting the overmolded spout unit.

BRIEF DESCRIPTION OF THE DRAWING

To have a better understanding of the invention reference is made to the following detailed description of the invention and embodiments thereof in conjunction with the accompanying drawings. In the various figures of the drawings, like reference numbers are used to designate like parts.

DETAILED DESCRIPTION OF THE INVENTION

Figure 1:
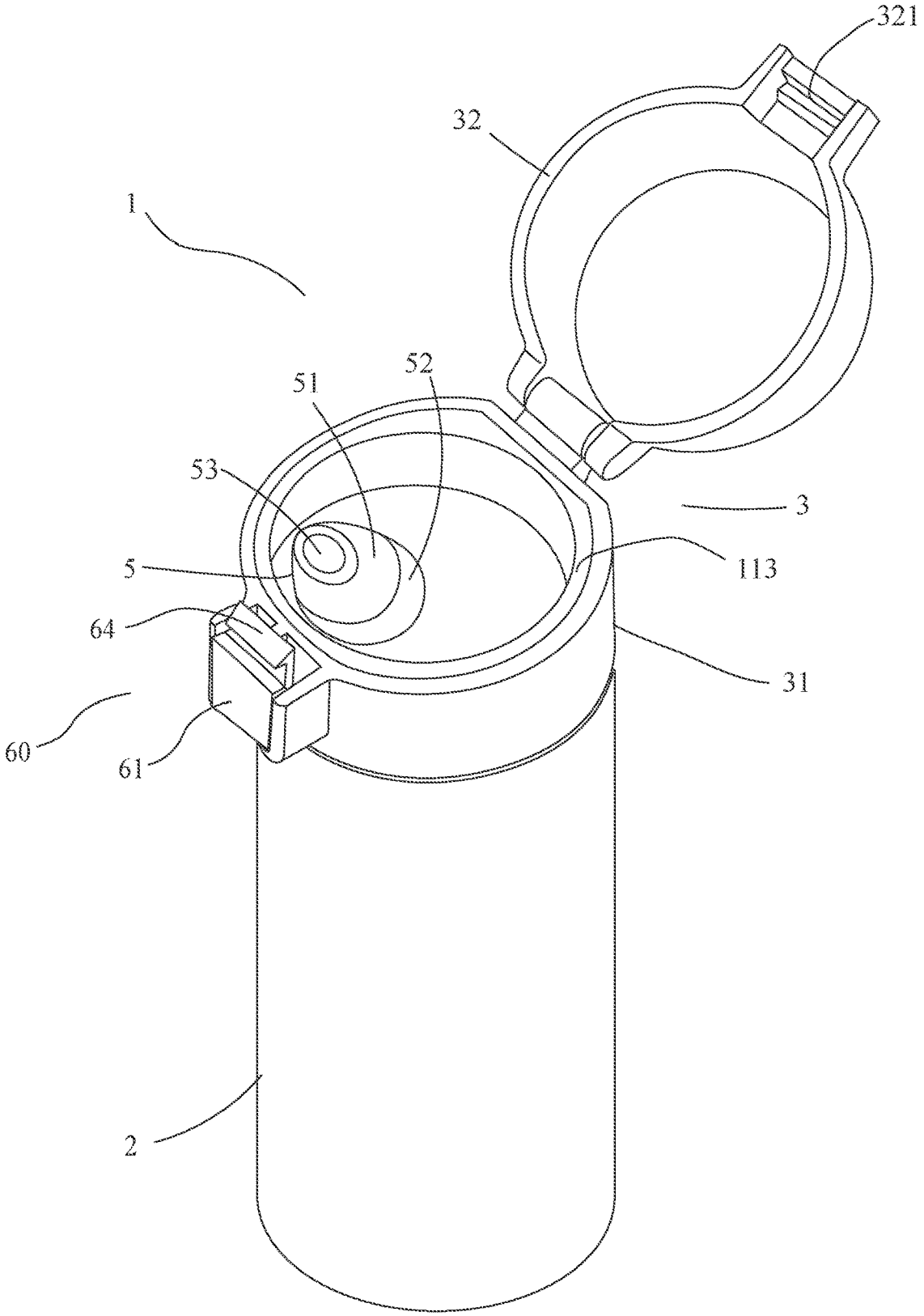
FIG. 1 is a schematic perspective view showing a beverage container assembly of the present invention.
Figure 2A:
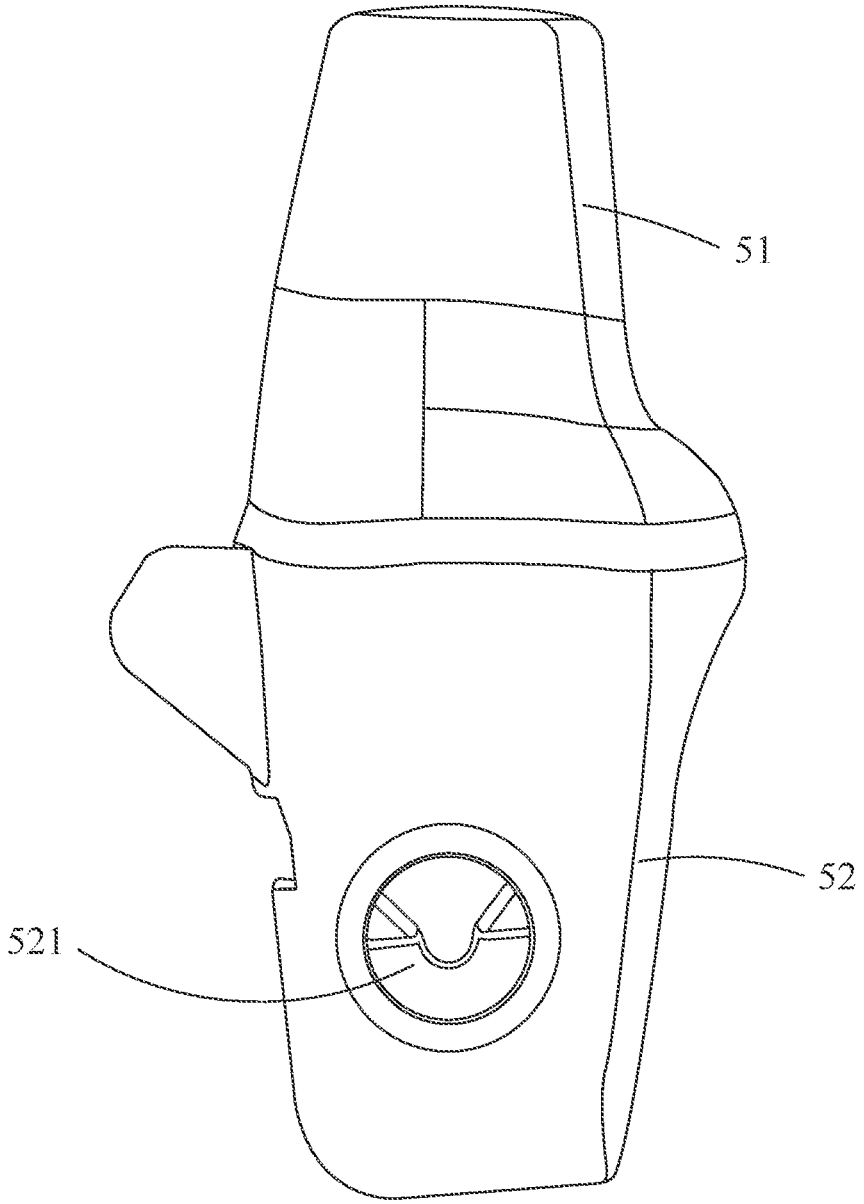
FIG. 2A is an elevational view of one side of a spout unit of the present invention.
Figure 2B:
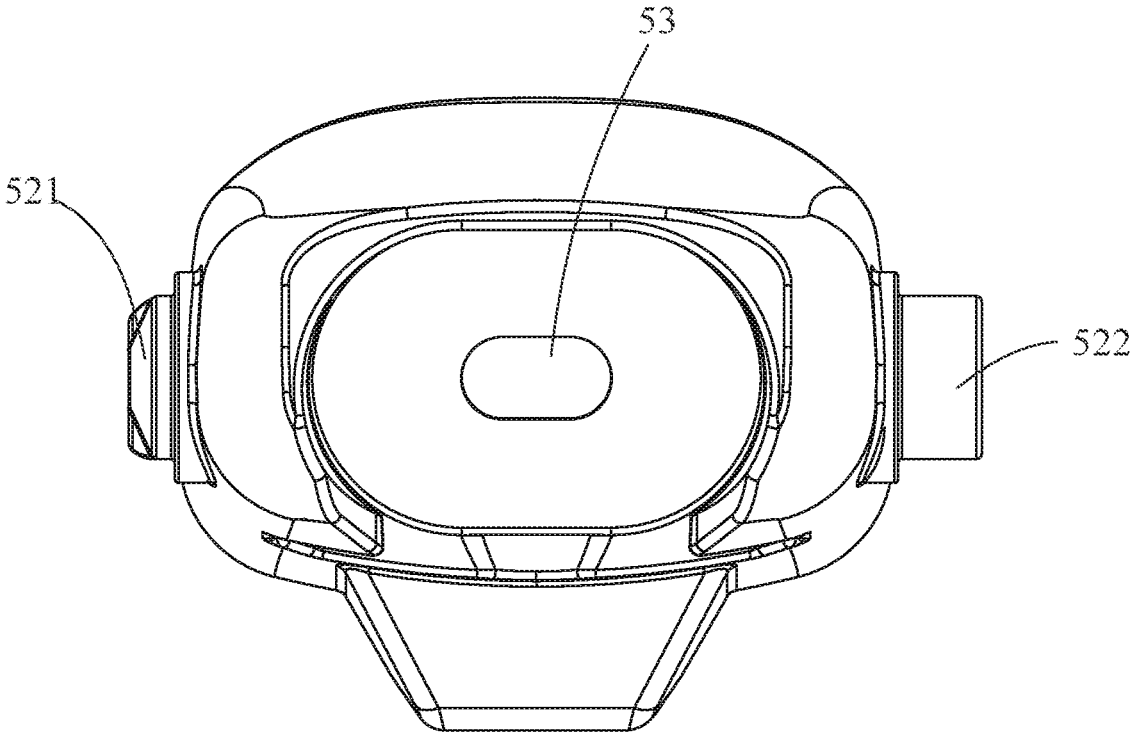
FIG. 2B a bottom view of the spout unit shown in FIG. 2A.

While the present invention is illustrated and described in preferred embodiments, the spout unit of the present invention may be produced in many different configurations, sizes, forms and materials to assemble with the lid assembly for dispensing beverage in a beverage container.

Referring now to the drawings, FIGS. 1 to 5C illustrate a beverage container assembly 1 comprising a spout unit of the invention. As illustrated, the container assembly 1 comprises a container 2 having a top opening, and a lid assembly 3 connected to the container 2 for covering the top opening. The container 2 is used to contain or store contents such as liquid and may be of any type known in the art. The lid assembly 3 comprises a lid body 31, a spout unit 5 mounted in the lid body 31, and a cover member 32 pivotally mounted on the lid body 31.

The lid body 31 is adapted to be removably attached to the opening of the container. As shown in FIG. 1, the lid body 31 has a window formed therethrough and is molded integrally from, for example, a plastic material. The window is provided to receive and engage with the spout unit 5, which will be discussed hereinbelow. The lid body 31 has internal threads for mating engagement with corresponding threads formed on an outside of the opening of the container 2.

Now turning to FIGS. 2A to 5C, there is illustrated the spout unit 5 constructed consistent with a first embodiment of the invention. The spout unit 5 comprises a spout 51 and a reinforcement unit 52 coupled with the spout 51. In this embodiment, the spout 51 and the reinforcement unit 52 are overmolded as a unitary structure. The spout 51 may be made of a flexible material, e. g. silicon material; and the reinforcement unit 52 may be made of a rigid material, e. g. nylon material.

Figure 3A:
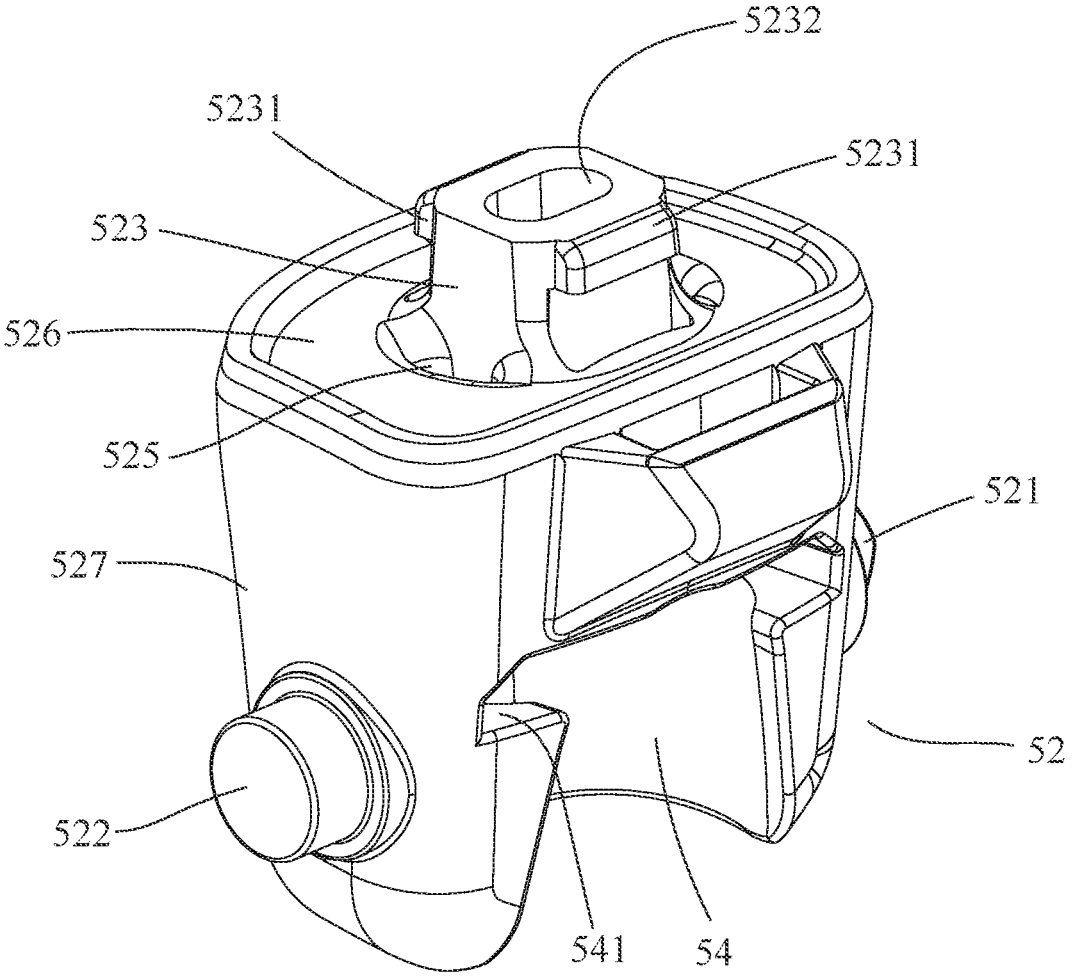
FIG. 3A is a perspective view showing a reinforcement unit constructed consistent with a first embodiment according to the present invention.
Figure 3B:
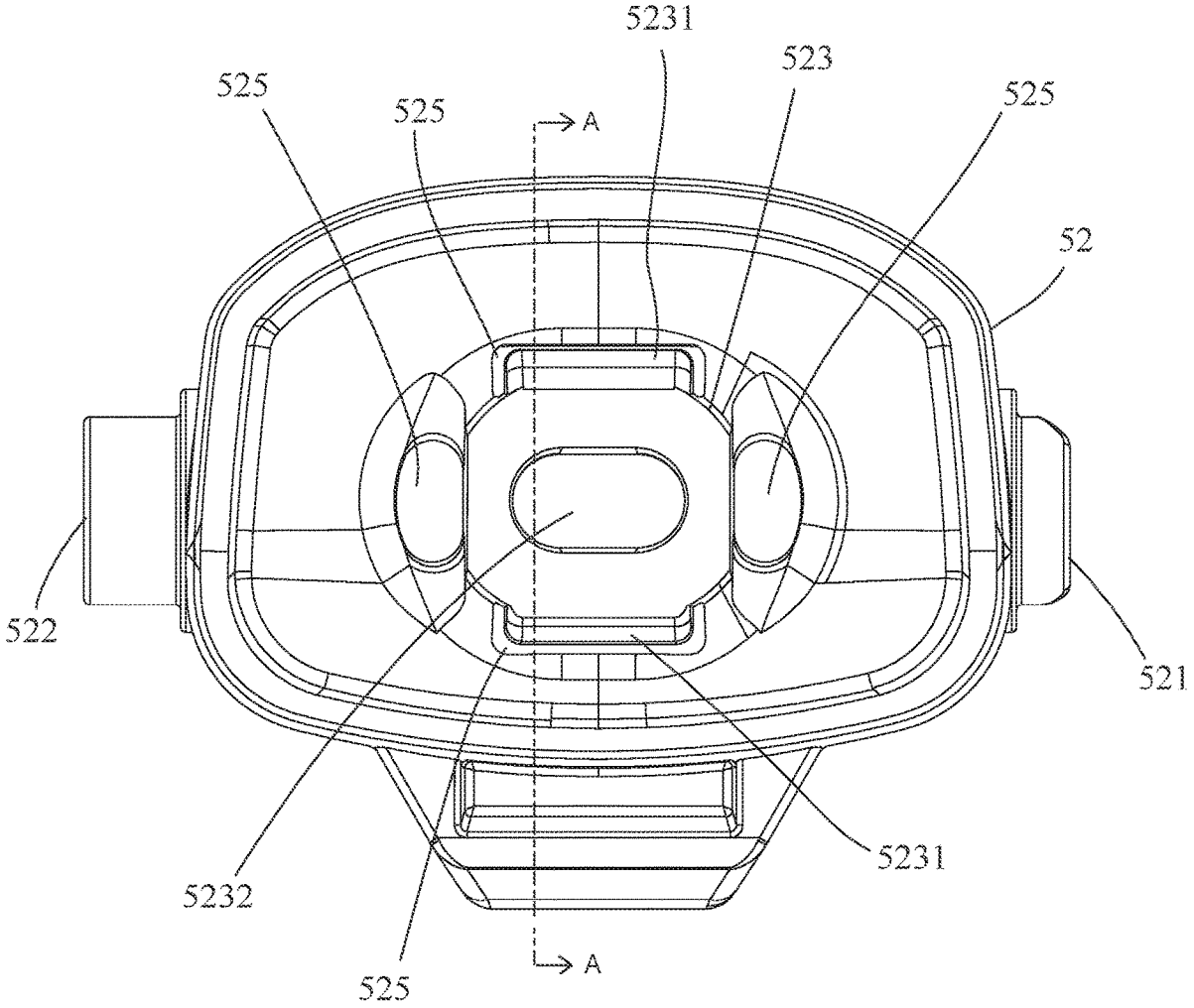
FIG. 3B is a top view of the reinforcement unit of FIG. 3A.

The reinforcement unit 52 comprises a main body 527 of a substantially rectangular frame having a top wall 526 and a receiving chamber 54 inside the main body 527. The receiving chamber 54 comprises a pair of lateral slots 541 opposite to and facing each other on two opposite inner sides of the receiving chamber. The reinforcement unit 52 further comprises a linking portion 523 extending from the main body 527 to protrude beyond the top wall 526 of the main body 527 for engaging the spout 51. As shown in FIGS. 3A and 3B, the linking portion 523 has a bore 5232 which extends through the linking portion 526.

One of the features of the invention is that the reinforcement unit 52 comprises device for reinforcing interlocking of the reinforcement unit with the spout 51 to increase twist and pull strength for the spout 51, and thereby prevention of separation of the spout 51 from the reinforcement unit 52. As illustrated in FIGS. 3A and 3B, device for reinforcing in this embodiment comprises four shut off holes 525 adapted to receive flow of silicon material from the spout in the process of overmolding the spout 51 with the reinforcement unit 52. The shut off holes 525 are distributed circumferentially at an equal angular interval on the top wall 526. The device for reinforcing further comprises a pair of tabs 5231 extending transversely from opposite outer side wall surfaces of the linking portion 523 adjacent to a top surface of the linking potion 523.

Figure 4A:
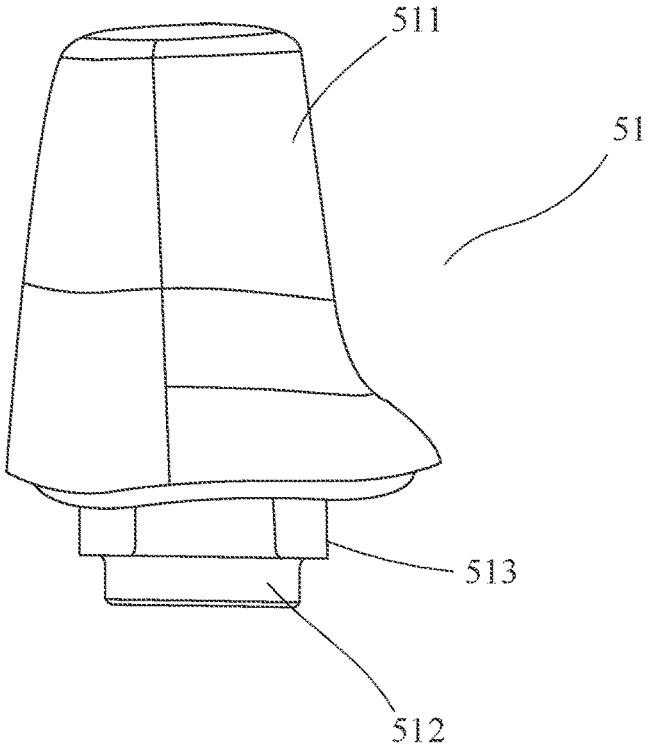
FIG. 4A is a side elevational view of the spout.
Figure 4B:
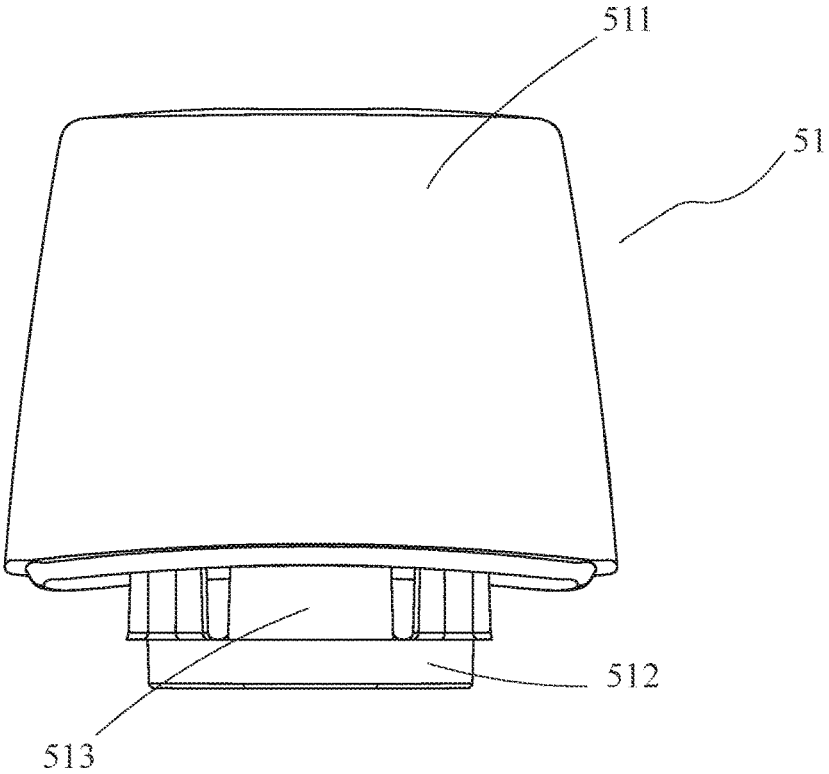
FIG. 4B is a front elevational view of the spout of FIG. 4A.
Figure 4C:
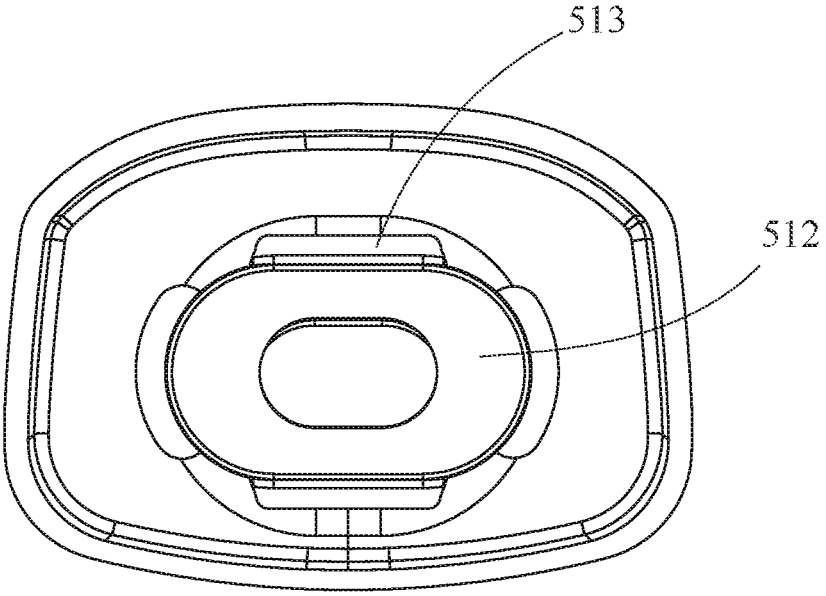
FIG. 4C is a bottom view of the spout of FIG. 4A.

Turning to FIGS. 4A to 4C, there is illustrated the spout 51 engageable with the reinforcement unit. As illustrated, the spout 51 comprises a mouthpiece 511 having a dispensing orifice 53 and a neck 512 extending downwardly from the mouthpiece 511. The dispensing orifice 53 of the mouthpiece is in fluid communication with the bore 5232 of the linking portion 523. The neck 512 may extend into the receiving chamber 54 of the reinforcement unit 52. The spout unit 5 is mounted in the lid body such that the mouthpiece 511 protrudes beyond the lid body 31, and the reinforcement unit 52 is pivotally mounted in the lid body 31 to enable pivotable movement of the spout 51 between a dispensing configuration and a stowed configuration, which will be discussed herein below.

In this embodiment, the spout 51 is formed by overmolding with the reinforcement unit 52. In the overmolding process, the silicon material of the spout 51 flows into the four shut off holes 525 of the reinforcement unit 52 and form, respectively, four ridges 513 on the outer side surface of the neck 512 of the spout 51. The ridges 513 create respectively four circumferential seals on the top between the reinforcement unit 52 and the spout 51. The spout 51 further comprises a pair of inwardly facing grooves 514 opposite to and facing each other on the two opposite inner side walls thereof. The pair of grooves 514 are positioned to be engageable with the pair of tabs 5231 of the linking portion 523. The engagement of the two tabs 5231 with the grooves 514 further enhances the interlocking between the reinforcement unit 52 and the spout 51. It would be within the ability of a person skilled in the art that, in order for further strengthen the interlocking of the spout 51 and the reinforcement unit, a second pair of inwardly facing grooves opposite to and facing each other on the two other opposite inner side walls of the spout 51 may be provided and positioned to be engageable with a second pair of tabs of the linking portion 523.

Figure 5A:
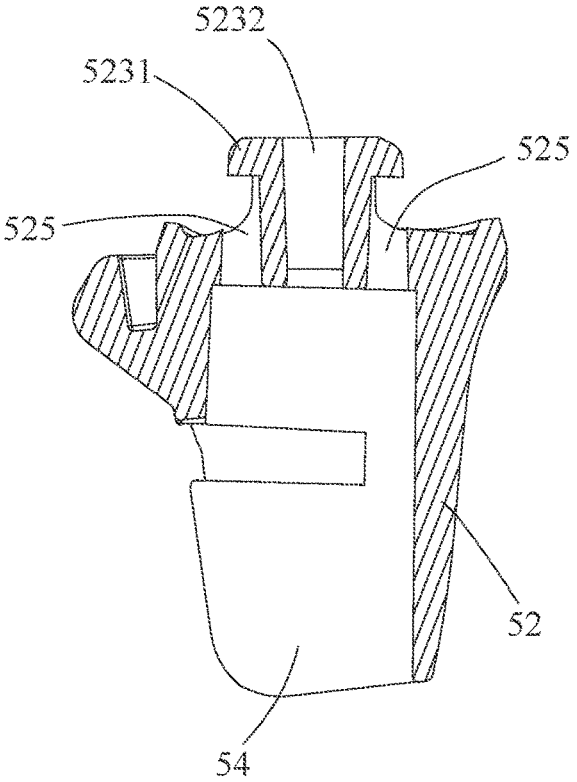
FIG. 5A is a cross-sectional view of the reinforcement unit taken along line A-A of FIG. 3B.
Figure 5B:
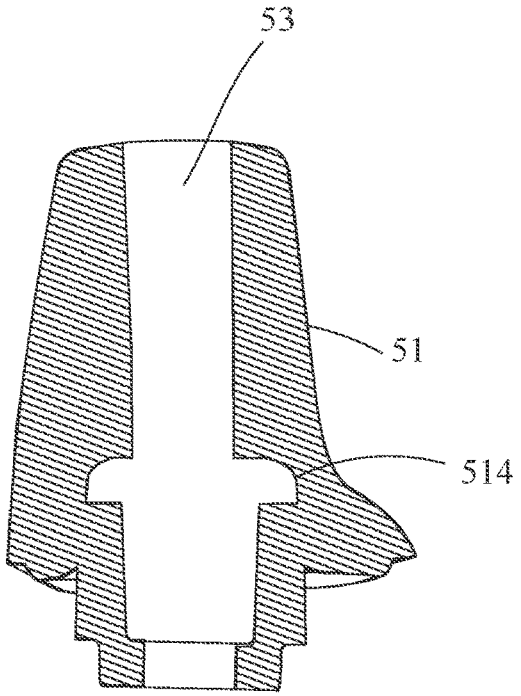
FIG. 5B is a cross-sectional view of the spout taken along a central line of FIG. 4A.
Figure 5C:
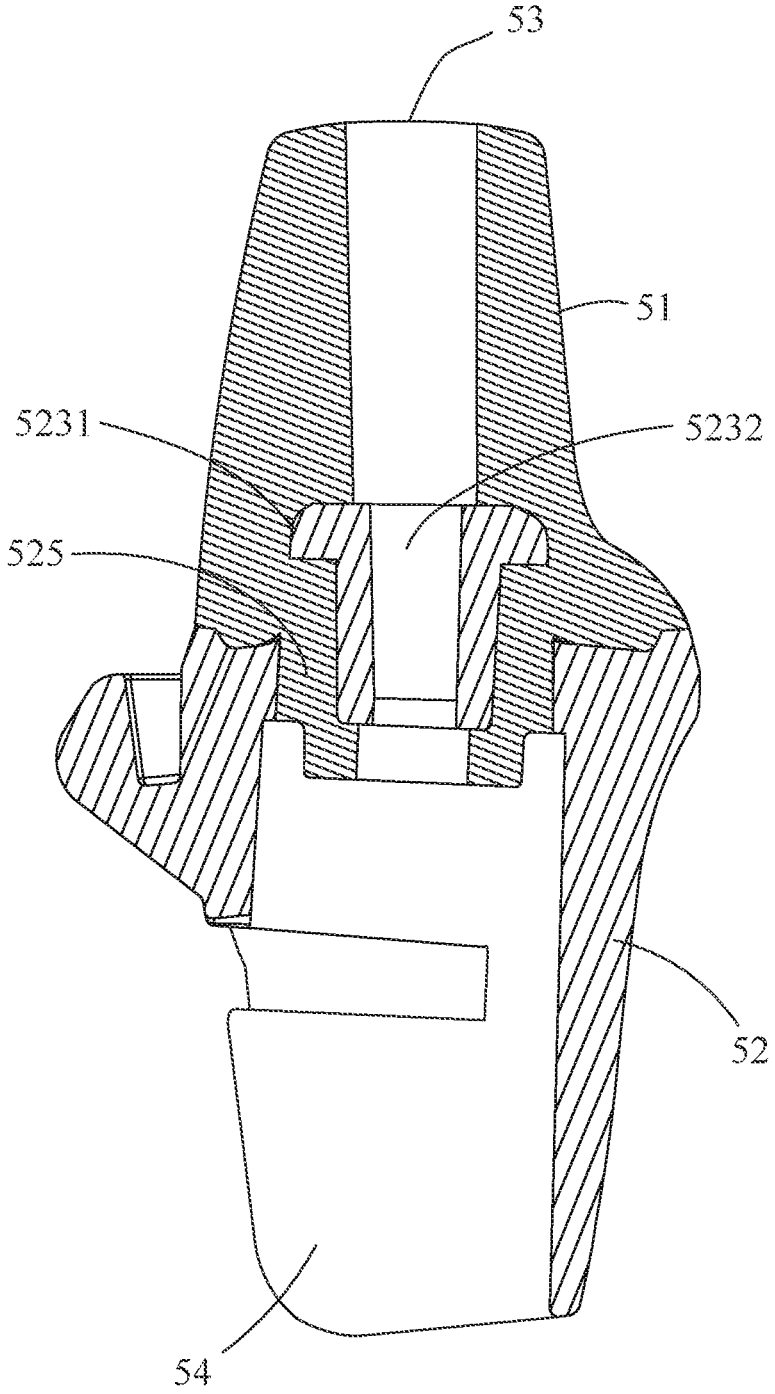
FIG. 5C is a cross-sectional view of an overmolded structure of the reinforcement unit of FIG. 5A and the spout of FIG. 5B taken along a central line of the overmolded structure.

FIGS. 5A to 5C show respective cross-sectional views of the spout 51, and the reinforcement unit 52, and their interlocking assembly. As illustrated, the silicon material of the spout 51 flows into the shut off holes 525 extending through the top wall 526 of the reinforcement unit 52 to establish a first interlocking feature, that is, the silicon flow forms the ridges 513. The pair of opposite tabs 5231 of the linking portion 523 of the reinforcement unit 52 engage the grooves 514 of the spout 51, which establishes a second interlocking feature. These two interlocking features can improve the strength onto the spout 51 and the twisting torque between the spout 51 and the reinforcement unit 52.

Figure 6A:
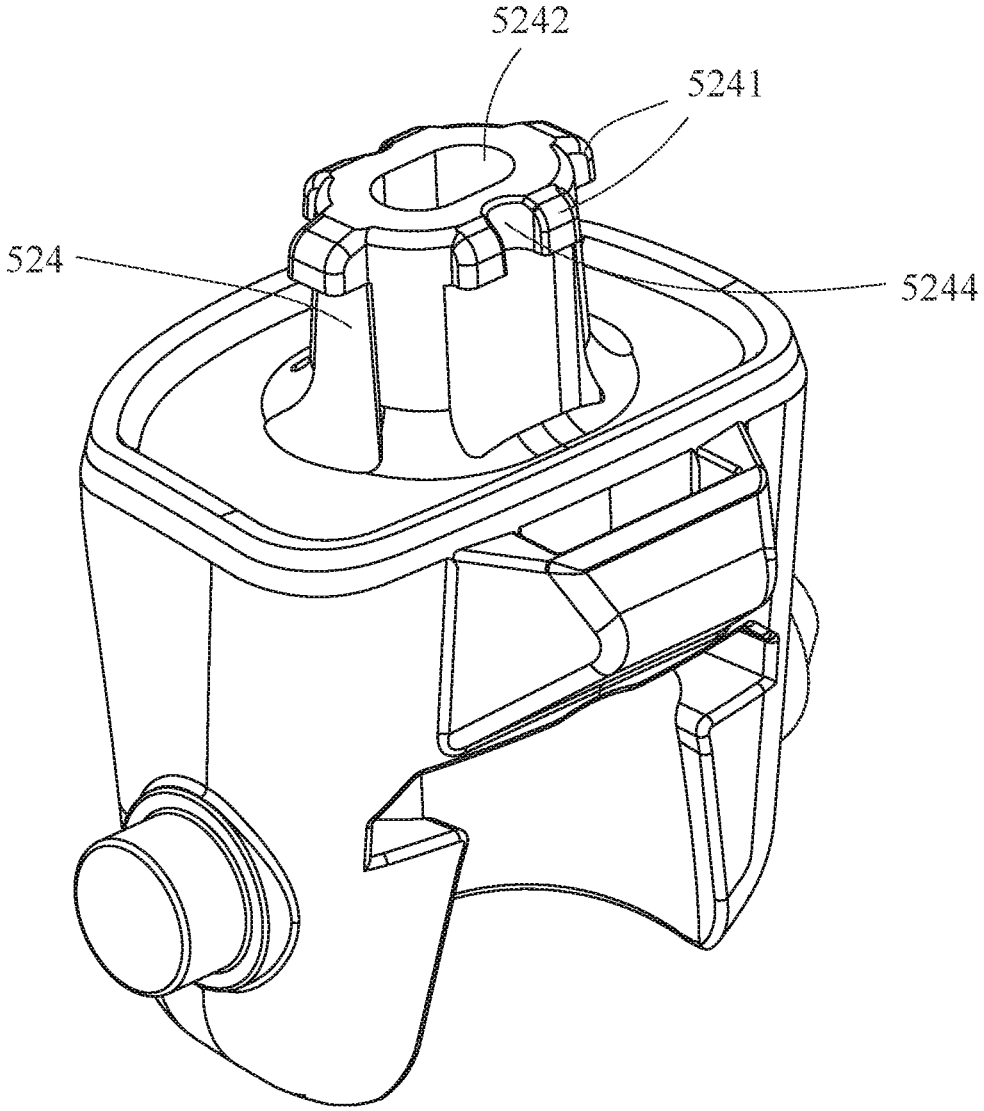
FIG. 6A is a schematic perspective view showing a reinforcement unit of the spout unit constructed consistent with a second embodiment according to the present invention.
Figure 6B:
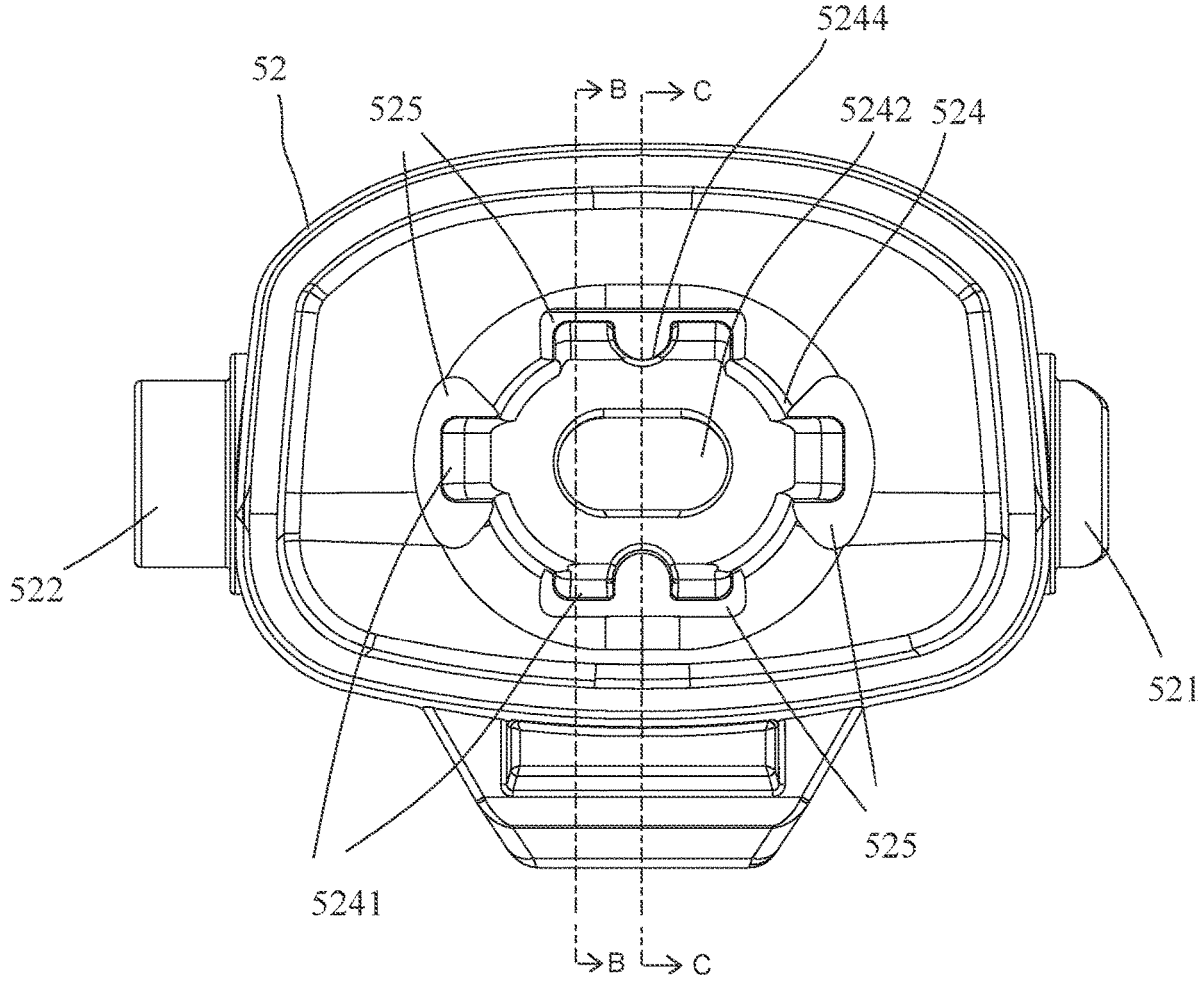
FIG. 6B is a top view showing the reinforcement unit of FIG. 6A.
Figure 6C:
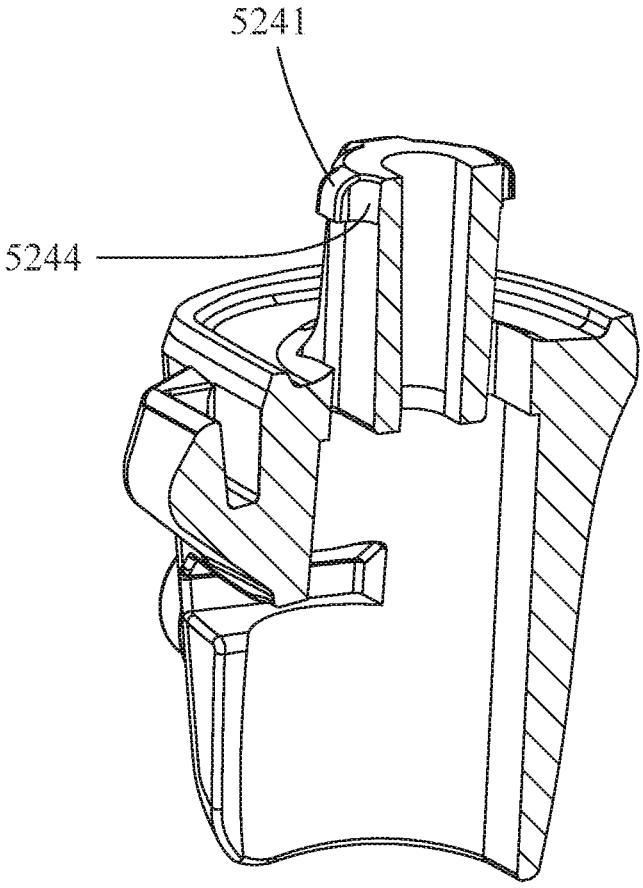
FIG. 6C is a cross-sectional perspective view of the reinforcement unit taken along line C-C of FIG. 6B.
Figure 7A:
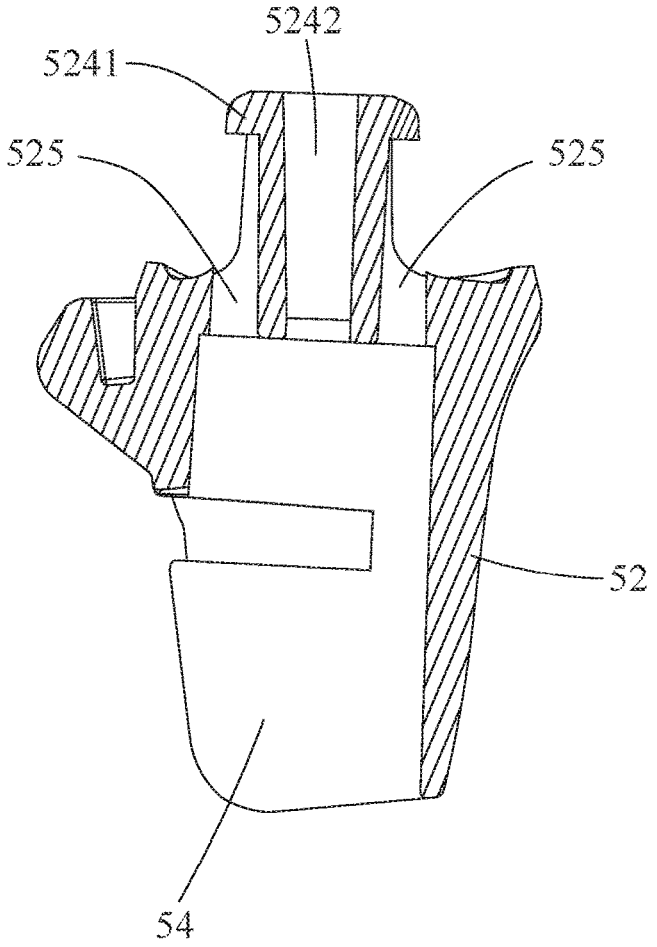
FIG. 7A is a cross-sectional view of the reinforcement unit taken along line B-B of FIG. 6B.
Figure 7B:
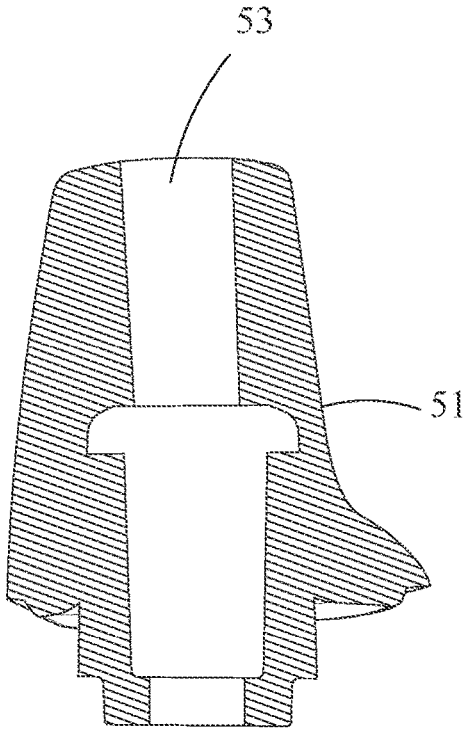
FIG. 7B is a cross-sectional view of the spout taken along a central line of the spout.
Figure 7C:
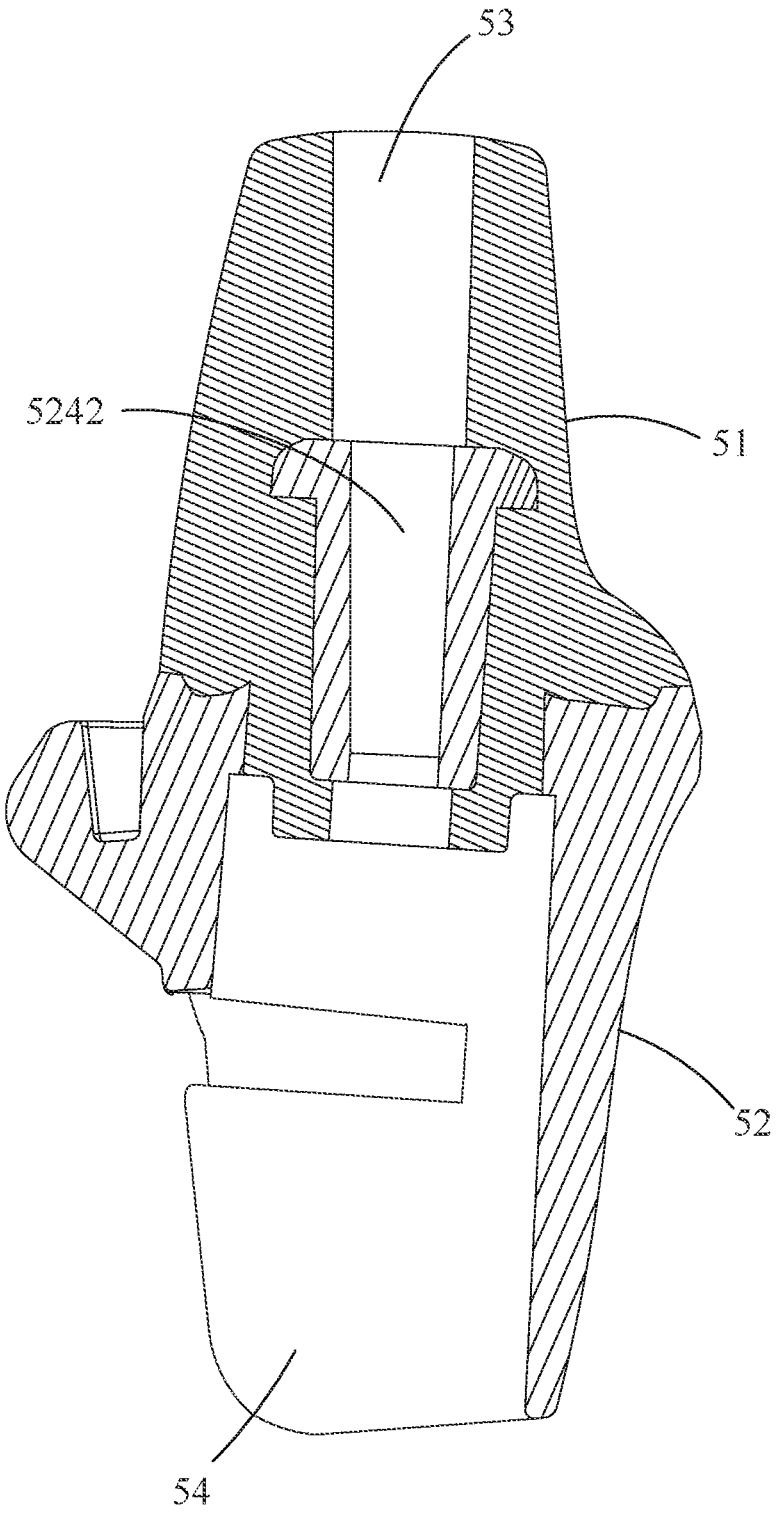
FIG. 7C. is a cross-sectional view of an overmolded structure of the reinforcement unit of FIG. 7A and the spout of FIG. 7B taken along a central line of the overmolded structure.

The reinforcement unit 52 comprises a first bulge 521 and a second bulge 522 provided on opposite side walls of the main body 527 thereof. The first and second bulges 521, 522 are configured as a first pivot and a second pivot for pivotably mounting the spout unit 5 on the lid body 31 (see FIGS. 6A and 6B). Because of the two pivots, the spout unit 5 is able to pivot relative to the lid body 31.

FIGS. 6A to 7C illustrate a spout unit constructed consistent with a second preferred embodiment of the present invention. The spout unit of this embodiment is structurally same as the one shown in the first embodiment above, except the following:

- the linking portion 524 has an increased height compared with the linking portion 523 of the first embodiment discussed above, the increased height of the linking portion may further enhance the pull strength of the spout; and
- one or more outwardly facing longitudinal grooves 5244 are formed axially in each of the tabs 514 of the linking portion 524, the one or more longitudinal grooves 5244 adapted to receive flow of material from the spout in the overmolding process to form ribs on an inner side wall of the mouthpiece of the spout; and the ribs may further enhance the pull strength and the twisting torque of the spout unit of this embodiment.

Now turning to FIGS. 6A to 6C and 7A, the linking portion 524 has a greater length in an axial direction, and two pairs of tabs 5241 extend transversely from opposite outer side wall surfaces of the linking portion 524, respectively. Each pair of tabs 5241 is positioned to engage a pair of inwardly facing grooves 514 opposite to and facing each other on the two opposite inner side walls of the spout 51. As shown clearly in FIGS. 6A, 6B and 6C, one pair of the tabs 5241 each has an outwardly facing longitudinal grooves 5244 formed axially in the tab, and the longitudinal grooves 5244 are adapted to receive flow of silicon material from the spout 51 in the overmolding process. The flow of silicon material forms ribs on an inner side wall of the mouthpiece 511 of the spout 51. The engagement of the ribs and the longitudinal grooves provides an additional improvement related to the interlocking between the spout 51 and the reinforcement unit 52.

These kinds of interlocking features in the second embodiment help to further strengthen the interlocking between the spout 51 and the reinforcement unit 52 to prevent the spout from detachment from the reinforcement unit 52.

Figure 8A:
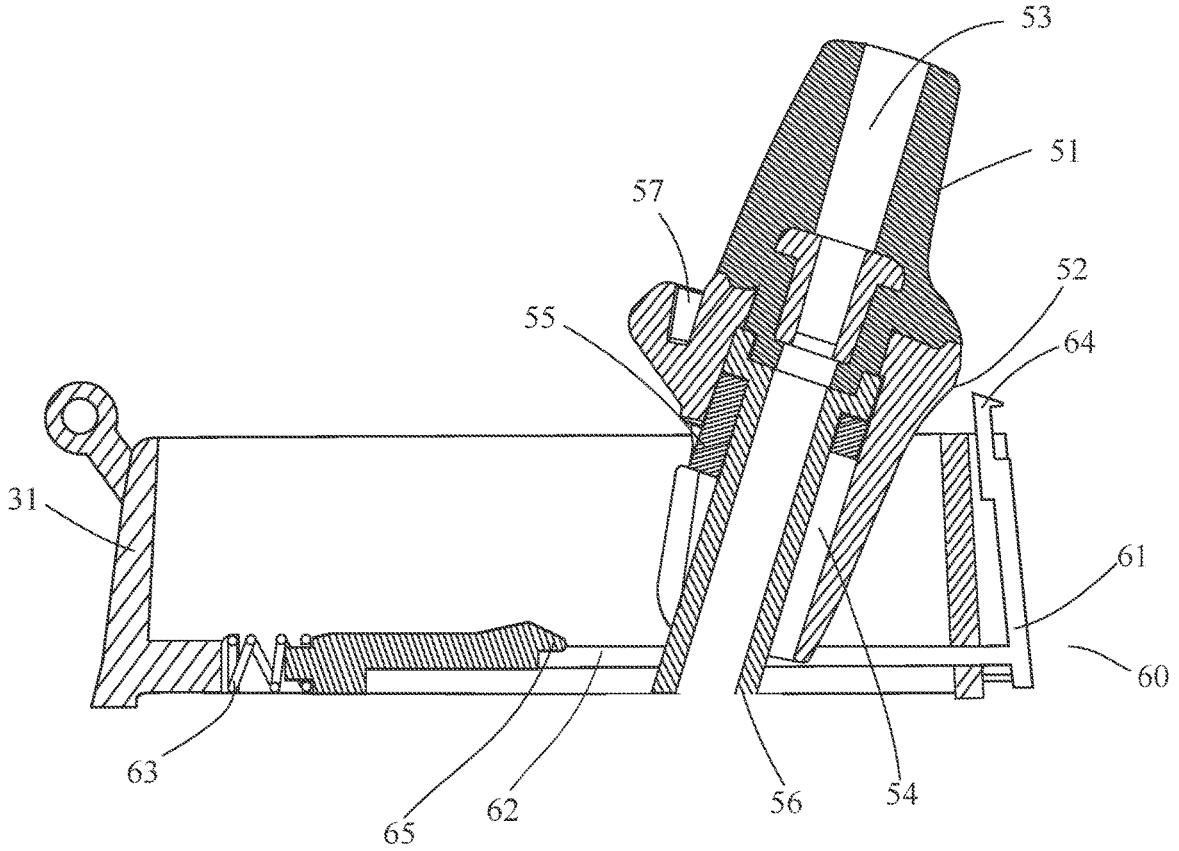
FIG. 8A is a schematic cross-sectional view of the spout unit mounted on a container lid in a dispensing configuration.
Figure 8B:
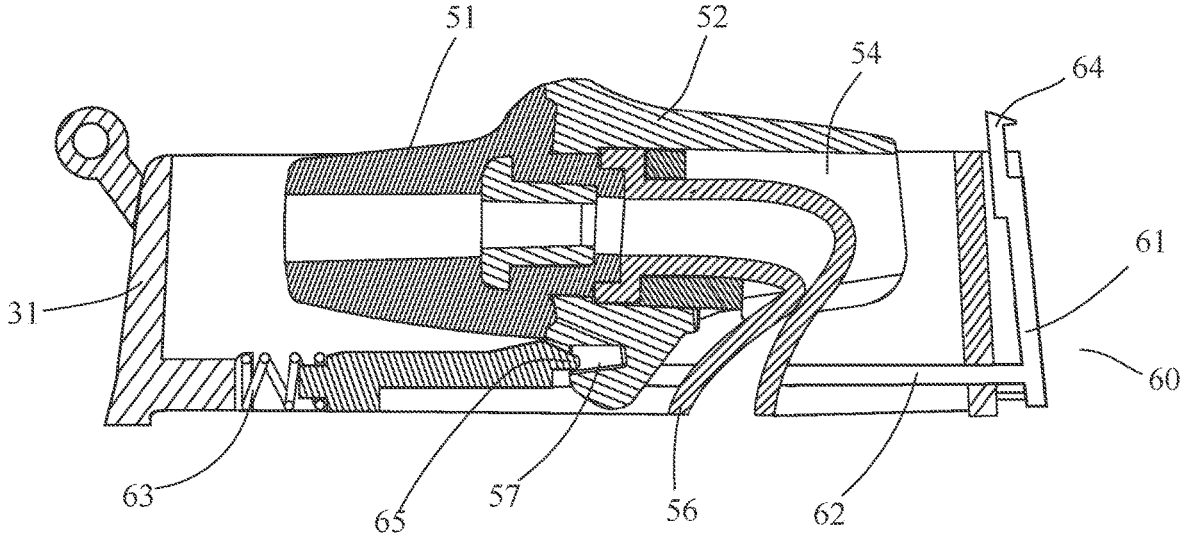
FIG. 8B is a schematic cross-sectional view of the spout unit mounted on a container lid in a stowed configuration.

As shown in FIGS. 8A and 8B, the lid assembly 3 further comprises a drinking straw 56 having one end portion coupled with the spout unit 5 and in fluid communication with the mouthpiece 511 of the spout 51. With reference to FIGS. 8A and 8B, the end portion of the drinking straw 56 is snugly received in the pair of inwardly facing lateral slots 541 of the receiving chamber 54 of the reinforcement unit 52. A retaining ring 55 is arranged between the inner wall of the main body 527 of reinforcement unit 52 and the drinking straw 56 to secure the drinking straw 56 inside the receiving chamber 54 and prevent displacement of the end portion of drinking straw 56 received in the spout unit.

To implement the locking and the unlocking of the cover member 32, a locking unit 60 is provided on the lid body 31. With reference to FIG. 1, the locking unit 60 is mounted on the lid body 31 on an opposite side to the pivotal point about which the cover member 32 pivots. The locking unit 60 comprises a push button 61 mounted on the lid body 31 and having a locking block 64 engageable with a locking seat 321 arranged on the cover member 32. The locking unit 60 further comprises a linkage 62 operably connected with the push button 61, and a compression spring 63 mounted between the linkage 62 and the lid body 31, as can be seen in FIGS. 8A and 8B. The linkage 62 has a hook 65 engageable with a recess 57 formed on the main body of the reinforcement unit 52. When an inward pressure is applied onto the push button 61, it would cause the locking block 64 to move inwardly, with a result of the locking block 64 disengaging from the locking seat 321 of the cover member 32 and at the same time of the hook of the linkage 62 disengaging from the recess 57 of the main body of the reinforcement unit 52, so that the cover member 32 is switched to the unlocked position accompanied with the unfolding of the spout unit into the dispensing configuration where the drinking straw 56 is unfolded to allow fluid communication between the mouthpiece 511 of the spout unit and the interior of the container 2 (see FIG. 8A). To close the container assembly 1, the spout unit 5 is pressed to fold downwardly into the stowed configuration where the drinking straw 56 is caused to bend to block the fluid pathway between the mouthpiece 511 of the spout unit and the interior of the container 2 (see FIG. 8B). The cover member 32 is then pressed down so that the locking seat 321 pivots downwardly to engage the locking block 64.

Figure 10:
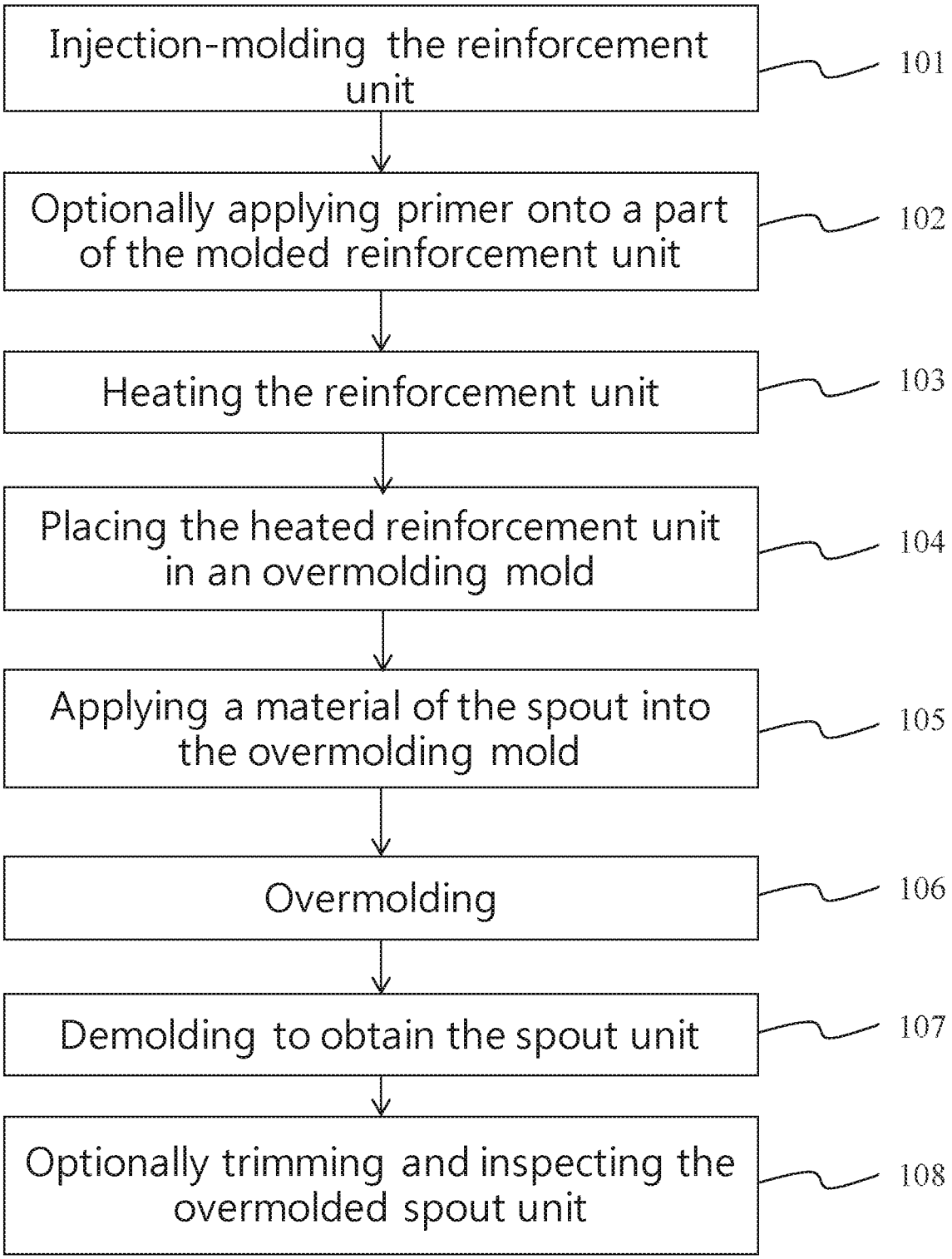
FIG. 10 is a schematic diagram illustrating the process for manufacturing the spout unit of the present invention.

FIG. 10 illustrates a method for fabricating the overmolding structure of the spout unit 5, the method comprising injection-molding the reinforcement unit of predefined structure and dimension (step 101). After the injection-molding of the reinforcement unit is finished, the reinforcement unit is released from the injection mold, and a primer is applied onto at least a part of the reinforcement unit intended to come into contact with the spout, including the top wall, the tabs, the shut off holes, the grooves or any combination thereof. The primer may include glues or adhesives. The reinforcement unit with the applied primer is then put in an oven and heated at a temperature between 130° C. and 180° C., preferably 150° C. for about 15 to 25 minutes (step 103). The heated reinforcement unit is placed in an overmolding mold (step 104), and a silicon material is applied into the overmolding mold for overmolding the spout around the linking portion of the reinforcement unit (steps 105 and 106). After the overmolding is finished, the unitary structure of the reinforcement unit and the spout is demolded from the overmolding mold (step 107), followed by the step of trimming and inspecting the overmolded spout unit (step 108).

The primer is applied to at least part of the reinforcement unit to enhance the coupling between the reinforcement unit 52 and the spout 51, such that the twisting and tearing strength can be further increased. The primers that are known in the art, for example YB-SS-7510, can be employed to the molded reinforcement unit.

Assays

Figure 9:
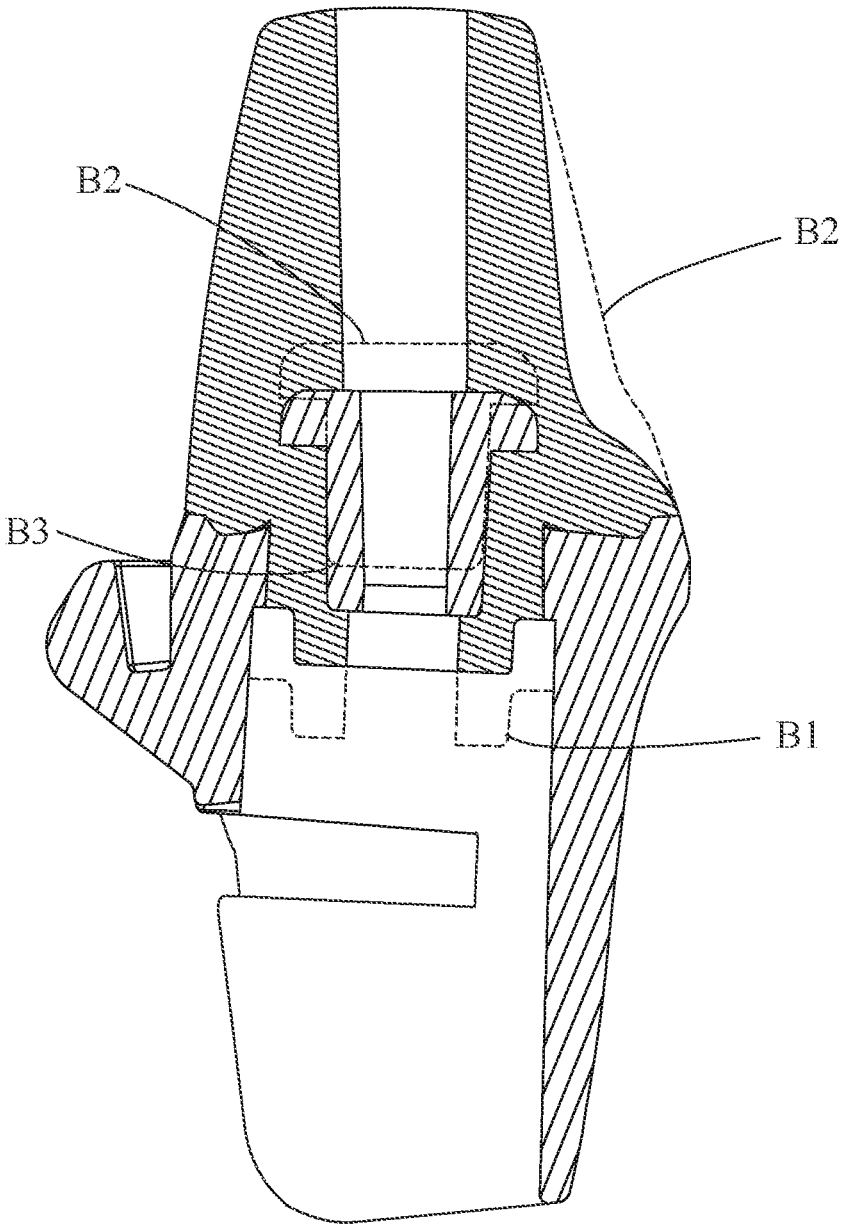
FIG. 9 is a schematic diagram illustrating variations of the device of reinforcing of the spout unit.

Assays were carried out for testing and verifying the twist and pull strength of the spout units with different variations according to the invention. Some of the variations of the spout units are shown in FIG. 9 and include the following:

Variation B1: the neck 512 of the spout 51 is configured to extend downward further.

Variation B2: the length of the linking portion 523, 524 is increased with increased thickness of the mouthpiece.

Variation B3: the top wall of the linking portion 523, 524 is configured to move closer towards the top edge of the main body 527.

Variation B4: additional pair of tabs 5231, 5241 is provided.

Variation B5: longitudinal grooves 5244 are formed in the tabs of the linking portion 523, 524.

Variation B6: the diameter of shut off holes 525 is increased.

Variations B1-B3 and B6 are devised to accommodate more material of the spout 51, and variation B4-B5 are devised to increase interlocking feature and interlocking surface area.

A series of samples of spout units were prepared for use in the following tests by the method of the invention discussed above, using ASCEND Vydyne 21 SPC PA66 resin as the nylon material for the reinforcement unit, POLYSIL LIM-9050D as the silicon material for the spout 51. The reinforcement units of these samples were fabricated to have four shut off holes comprising a first pair of front-back shut off hole and a second pair of left-right shut off holes shown in table 1.

TABLE 1

Dimensions of shut off holes

| Position of the holes | Width (mm) | Length (mm) |
|---|---|---|
| Front-Back shut off holes | 2.18 | 7.0 |
| Left-Right shut off holes | 3.9 | 6.4 |

In the assays, a mixture of YB-SS-7510A and YB-SS-7510B is used as the primer. The pulling test, twisting test and/or tearing test methods were employed in accord with industrial standard of CFR requirements.

Variations B5

Spout units having variation B5 were tested for their tearing strength. Six samples of spout units of identical structure were fabricated, with a same reinforcement unit in which the longitudinal grooves 5244 are provided on the front-back tabs of the linking portion. No primer was applied to these six samples.

The results are shown in table 2.

TABLE 2

Tearing Test results of spout units

| Sample | CW* (Nm) | CCW* (Nm) | Tear off position |
|---|---|---|---|
| A | 1.01 | 0.92 | Front side edge minor tear |
| B | 1.01 | 0.89 | Front edge tear |
| C | 0.97 | 0.89 | Back side edge |
| D | 0.99 | 0.84 | Back side edge minor tear |
| E | 1.01 | 1 | Front side edge minor tear |
| F | 0.99 | 1 | Front edge tear |

*CW—clockwise; CCW—counter clockwise

The above results reveal that improved tearing strength was conferred on the spouts in the spout units by the features of the shut off holes and the longitudinal grooves.

Variations B2, B4 and B5

Spout units having variations B2, B4 and B5 were tested for their twist torque and pulling strength. Some samples of spout units of identical structure were fabricated, with a same reinforcement unit which comprises the same elongated linking portion 524. The elongated linking portion 524 is provided with the same longitudinal grooves 5244 provided on the front-back tabs of the linking portion and an additional pair of tabs 5241 on the outer side wall surfaces of the elongated linking portion 524.

Tests were performed on the samples of spout units with and without primer.

The results are shown in tables 3 and 4.

TABLE 3

Test results of spout units without primer

| Sample Without Primer | Twist Torque to break (Nm) [a] | | Sample Without Primer | Pulling to break (kgf) [b] | |
|---|---|---|---|---|---|
| 1 | 1.36 | No Break | 21 | 18.87 | No peel off |
| 2 | 1.345 | No Break | 22 | 18.95 | No peel off |
| 3 | 1.287 | No Break | 23 | 18.72 | No peel off |
| 4 | 1.226 | No Break | 24 | 16.57 | No peel off |
| 5 | 1.288 | No Break | 25 | 16.73 | No peel off |
| 6 | 1.187 | No Break | 26 | 16.59 | No peel off |

TABLE 3-continued

Test results of spout units without primer

| Sample Without Primer | Twist Torque to break (Nm) [a] | | Sample Without Primer | Pulling to break (kgf) [b] | |
|---|---|---|---|---|---|
| 7 | 1.288 | No Break | 27 | 17.81 | No peel off |
| 8 | 1.259 | No Break | 28 | 17.47 | No peel off |
| 9 | 1.204 | No Break | 29 | 17.33 | No peel off |
| 10 | 1.167 | No Break | 30 | 18.13 | No peel off |
| 11 | 1.191 | No Break | 31 | 15.37 | No peel off |
| 12 | 1.31 | Back side tab slightly crack | 32 | 18.71 | No peel off |
| 13 | 1.251 | No Break | 33 | 18.94 | No peel off |
| 14 | 1.322 | Back side tab slightly crack | 34 | 17.74 | No peel off |
| 15 | 1.194 | No Break | 35 | 18.49 | No peel off |
| 16 | 1.194 | No Break | 36 | 17.7 | No peel off |
| 17 | 1.247 | No Break | 37 | 15.37 | No peel off |
| 18 | 1.234 | No Break | 38 | 18.38 | No peel off |
| 19 | 1.242 | No Break | 39 | 17.32 | No peel off |
| 20 | 1.226 | No Break | 40 | 16.51 | No peel off |

[a] CFR requirement is 0.45 Nm
[b] CFR requirement is 6.8 kgf

TABLE 4

Test results of spout units with primer

| Sample With Primer | Pulling to break (kgf) [b] | | Sample With Primer | Twist Torque to break(Nm) [a] | |
|---|---|---|---|---|---|
| 41 | >20 | No peel off | 51 | >0.7 | No Break |
| 42 | >20 | No peel off | 52 | >0.7 | No Break |
| 43 | >20 | No peel off | 53 | >0.7 | No Break |
| 44 | >20 | No peel off | 54 | >0.7 | No Break |
| 45 | >20 | No peel off | 55 | >0.7 | No Break |
| 46 | >20 | No peel off | 56 | >0.7 | No Break |
| 47 | >20 | No peel off | 57 | >0.7 | No Break |
| 48 | >20 | No peel off | 58 | >0.7 | No Break |
| 49 | >20 | No peel off | 59 | >0.7 | No Break |
| 50 | >20 | No peel off | 60 | >0.7 | No Break |

[a] CFR requirement is 0.45 Nm
[b] CFR requirement is 6.8 kgf

The data shown in tables 3 and 4 reveals that the spout units 5 having the features of the elongated linking portion 524 with additional tabs 5241 and longitudinal grooves 5244 exhibit a substantially increased performance in terms of twist torque and pulling strength. Application of the primer is found to further increase the interlocking strength and the twisting torque between the reinforcement unit and the spout.

While the above described are preferred embodiments of the spout unit of the present invention with what is presently considered to be the most practical and preferred arrangement, it should be appreciated that the invention is not limited to the disclosed embodiments, and is intended to cover various modifications and equivalent arrangements included within the spirit and scope of the claims. Modifications and variations in the present invention may be made without departing from the novel aspects of the invention as defined in the claims, and this application is limited only by the scope of the claims.

What is claimed is:

1. A spout unit for dispensing beverage in a beverage container, comprising:

a spout comprising a mouthpiece having a dispensing orifice, and a neck extending downwardly from the mouthpiece, and a reinforcement unit overmolded with the spout, wherein the reinforcement unit comprises:

a main body having a top wall and a receiving chamber, a linking portion extending from the main body to protrude beyond the top wall of the main body for engaging the spout, the linking portion having a bore which extends through the linking portion and is in fluid communication with the dispensing orifice of the spout, and a device for reinforcing structurally interlocking of the reinforcement unit with the spout.

2. The spout unit of claim 1, wherein the device for reinforcing includes one or more shut off holes and/or depressions adapted to receive flow of material from the spout in the overmolding process, and wherein the flow of material forms one or more ridges on an outer side surface of the neck of the spout.

3. The spout unit of claim 2, wherein the shut off holes and/or depressions are distributed circumferentially on the top wall.

4. The spout unit of claim 1, wherein the device for reinforcing includes at least a pair of tabs extending transversely from opposite outer side wall surfaces of the linking portion, the pair of tabs being positioned to engage a pair of inwardly facing grooves opposite to and facing each other on the two opposite inner side walls of the spout.

5. The spout unit of claim 1, wherein two pairs of tabs extending transversely from opposite outer side wall surfaces of the linking portion, respectively, each of the pairs of tabs being positioned to engage a pair of inwardly facing grooves opposite to and facing each other on the two opposite inner side walls of the spout.

6. The spout unit of claim 5, wherein one or more outwardly facing longitudinal grooves are formed axially in each of the tabs, the one or more longitudinal grooves adapted to receive flow of material from the spout in the overmolding process, and wherein the flow of material forms one or more ribs on an inner side wall of the mouthpiece of the spout.

7. The spout unit of claim 1, wherein the reinforcement unit comprises a first bulge and a second bulge provided on opposite side walls of the main body thereof, the first and second bulges configured as a first pivot and a second pivot for pivotably mounting the spout unit.

8. The spout unit of claim 1, wherein the receiving chamber comprises a pair of lateral slots opposite to and facing each other on two opposite inner sides of the receiving chamber.

9. The spout unit of claim 1, wherein the spout and the reinforcement unit are overmolded as a unitary structure.

10. The spout unit of claim 1, wherein the spout is made of a flexible material, and the reinforcement unit is made of a rigid material.

11. The spout unit of claim 10, wherein the spout comprises silicon material, and the reinforcement unit comprises nylon material.

12. A lid assembly coupled to a beverage container for covering an opening of the beverage container, comprising:

a lid comprising a lid body adapted to be placed over and coupled to the opening of the container, and a spout unit according to claim 1, the spout unit being pivotably mounted on the lid body.

13. The lid assembly of claim 12, further comprising a drinking straw having one end portion received in the receiving chamber of the main body of the reinforcement unit and in fluid communication with the mouthpiece of the spout.

14. The lid assembly of claim 13, wherein the receiving chamber comprises a pair of lateral slots opposite to and facing each other on two opposite inner sides of the receiving chamber, and the pair of slots are adapted to engage the end portion of the drinking straw.

15. The lid assembly of claim 12, wherein the lid further comprises a cover member pivotably mounted on the lid body and pivotal between a locked position where the spout unit is allowed to fold into a stowed configuration, and an unlocked position where the cover member pivots upwardly, thereby allowing the spout unit to unfold into a dispensing configuration for dispensing the beverage.

16. The lid assembly of claim 15, wherein a locking unit is pivotally mounted on the lid body for locking the cover member in the locked position when the locking unit is engaged with the cover member and unlocking the cover member when the locking unit is disengaged from the cover member.

17. A method for manufacturing a spout unit according to claim 1, comprising:

(a) injection-molding the reinforcement unit,
(b) heating the injection-molded reinforcement unit at a predetermined temperature for a period of time,
(c) placing the heated reinforcement unit in an overmolding mold,
(d) applying a material of the spout into the overmolding mold for overmolding the spout around the linking portion of the reinforcement unit, and
(e) demolding the overmolded spout unit.

18. A method according to claim 17, further comprising applying a primer onto at least a part of the reinforcement unit intended to come into contact with the spout prior to the heating (b) of the injection-molded reinforcement unit.

19. A method according to claim 18, wherein the part of the reinforcement to be in contact with the spout is selected from the group consisting of the top wall, the tabs, the shut off holes or depressions, the grooves and any combination thereof.

20. A method according to claim 17, wherein the heating (b) of the injection-molded reinforcement unit is conducted at a temperature between 120° and 200° for 10 to 30 minutes.

* * * * *